United States Patent [19]

Suzuki

[11] Patent Number: 4,508,001

[45] Date of Patent: Apr. 2, 1985

[54] ELECTRONIC MUSICAL INSTRUMENT USING LARGE-CAPACITY RECORDING MEDIUM

[75] Inventor: Hideo Suzuki, Shizuoka, Japan

[73] Assignee: Nippon Gakki Seizo Kabushiki Kaisha, Shizuoka, Japan

[21] Appl. No.: 633,940

[22] Filed: Jul. 24, 1984

[30] Foreign Application Priority Data

Jul. 29, 1983 [JP] Japan ..... 58/137575

[51] Int. Cl.[3] ..... G10H 1/00

[52] U.S. Cl. ..... 84/1.01; 84/1.18; 84/1.19; 364/900

[58] Field of Search ..... 364/200, 900; 84/1.01, 84/1.03, 1.18, 1.19, 1.24, 1.28

[56] References Cited

U.S. PATENT DOCUMENTS 3,652,776 3/1972 Milde, Jr. ..... 84/1.28

4,383,462 5/1983 Nagai ..... 84/1.26

*Primary Examiner*—Forester W. Isen

*Attorney, Agent, or Firm*—Blakely, Sokoloff, Taylor & Zafman

[57] ABSTRACT

An electronic musical instrument includes a keyboard having keys, an optical disc memory which is low-speed in access and very large in capacity, a semiconductor memory which is high-speed in access and very small in capacity, and readout circuit. The semiconductor memory stores an initial portion corresponding to a short period from the start of a tone waveshape. The optical disc memory stores a remaining portion succeeding the initial portion in the tone waveshape. The readout circuit starts to read out the initial portion and the remaining portion at the same time in response to a key depression. The short period is in advance determined so as to be equal to or longer than an access time required to read out the first data of the remaining portion. Therefore, the initial portion is firstly read out and thereafter the remaining portion is read out, so that the low-speed accessibility of the optical disc memory is compensated with the high-speed accessibility of the semiconductor memory.

16 Claims, 6 Drawing Figures

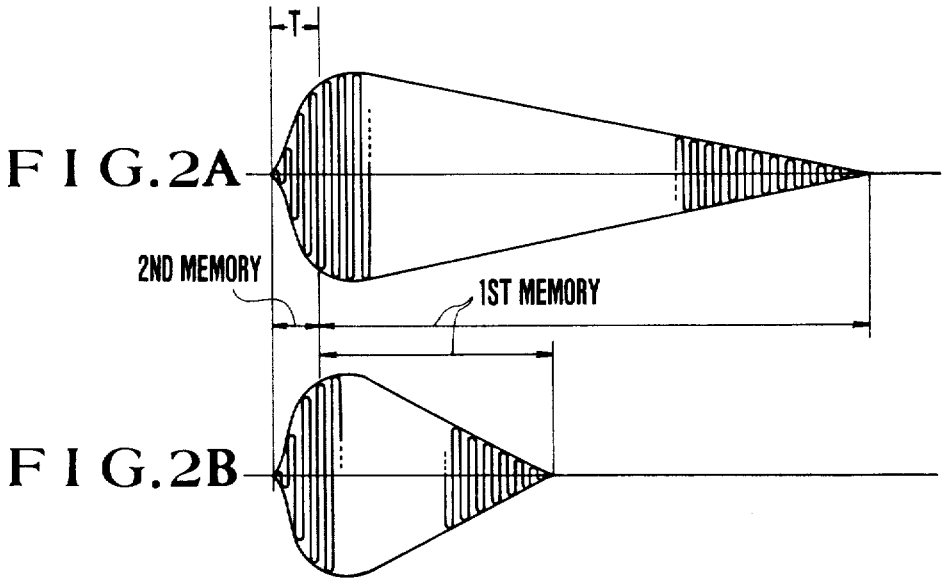
FIG.2A
FIG.2B
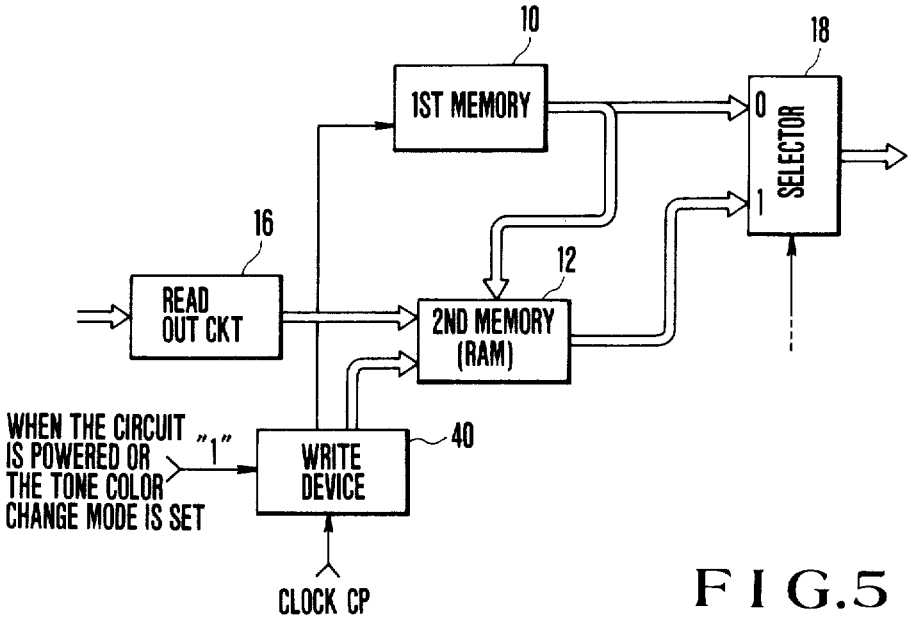
FIG.5

ELECTRONIC MUSICAL INSTRUMENT USING LARGE-CAPACITY RECORDING MEDIUM

BACKGROUND OF THE INVENTION

The present invention relates to an electronic musical instrument and, more particularly, to an electronic musical instrument which has a large-capacity recording medium for storing waveform data and which can read out waveform data associated with a tone to be produced.

A method of producing a tone signal is conventionally known and is described, for example, in U.S. Pat. No. 4,383,462, wherein all waveform data from the beginning to the end of a musical tone signal produced by a conventional musical instrument are stored in a waveform memory and are read out at a desired rate to obtain high-quality musical tones. According to this typical conventional method, a semiconductor memory is used as the waveform memory. A waveshape memory WM31 shown in FIG. 3 of U.S. Pat. No. 4,383,462 stores a complete waveform from the beginning to the end of a musical tone signal. However, a large-capacity semiconductor memory is required to store complete waveforms for all keys, resulting in high cost. In particular, when waveform data representing a long tone is stored, the semiconductor memory becomes extremely expensive.

In order to solve this problem, in FIG. 6 of U.S. Pat. No. 4,383,462, a component of the complete waveform during an attack period is stored in a waveshape memory WM61, and another component during a fundamental period after the attack period is stored in a waveshape memory WM62. An attack waveform is read out from the waveshape memory WM61 in response to a KD signal representing a key depression timing. A fundamental period waveform is repetitively read out from the waveshape memory WM62 during a time interval after the attack waveform is completely read out (IMF signal) and until a tone end signal (DF signal) is generated. However, strictly speaking, according to this method, discontinuity arises in a connecting portion between the repetitively read out period waveforms. Therefore, the complete waveform is preferably stored in the waveshape memory.

Another example for storing the complete waveform is also described in U.S. Pat. No. 4,383,462 wherein a reading system known as a flying spot scanner is used. As shown in FIGS. 1 and 2 of this prior art, waveform data of a tone to be produced is stored in a film 12, and the waveform storage portion of the film 12 is scanned with a spot beam from a cathode-ray tube 10 at a rate corresponding to the key depression pitch. Resultant transmitted light is detected by a photo cell, and photoelectric conversion is performed.

Still another example for detecting a waveform amplitude in accordance with the amount of transmitted light is given by a system using an external large-capacity recording medium such as an optical disk, a magneto-optical disk, or a floppy disk. According to this system, a large number of waveform data can be stored at relatively low cost, resulting in convenience. In an apparatus using such a large-capacity recording medium, however, it takes a long time to trace a read head to a start point of a memory area of waveform data to be read out. Such a long access time is not suitable for an electronic musical instrument for producing musical tones in a real-time manner upon key depression (tone selection operation). For example, in floppy disks which are prevalent these days, the tracking time becomes several hundreds of miliseconds, thereby delaying production of a musical tone upon depression of a key and hence disabling real-time musical performance.

Furthermore, when waveform data becomes larger, they are stored on both sides of a floppy disk or in a plurality of sectors or tracks thereof, and in this case the access time is further delayed when data access is performed across the sectors or tracks or for the opposite side of the disk.

SUMMARY OF THE INVENTION

It is a principal object of the present invention to provide an electronic musical instrument wherein a time between key depression and tone production is negligible even though a large-capacity memory device subjected to a long access time is used.

According to the present invention, there is provided a second memory which has a smaller capacity and a higher access speed than those of a first memory. Partial waveform data is stored in the second memory. A memory switching means is arranged to selectively use one of the outputs from the first and second memories so as to produce a musical tone signal. In normal operation, the musical tone signal is produced on the basis of the waveform data read out from the first memory. During a time interval corresponding to an access delay time of the first memory, the waveform data is read out from the second memory to form a musical tone signal. During this short time interval, the musical tone signal is produced on the basis of the waveform data read out from the high-speed second memory to compensate for the access delay of the first memory, thereby providing a good real-time musical performance.

BRIEF DESCRIPTION OF THE DRAWINGS

FIGS. 2A and 2B show waveforms for explaining access cycles of waveform data from the first and second memories in FIG. 1;

FIG. 5 is a block diagram showing a modification of the second memory of FIG. 1.

DETAILED DESCRIPTION OF THE PREFERRED EMBODIMENT

Figure 1:
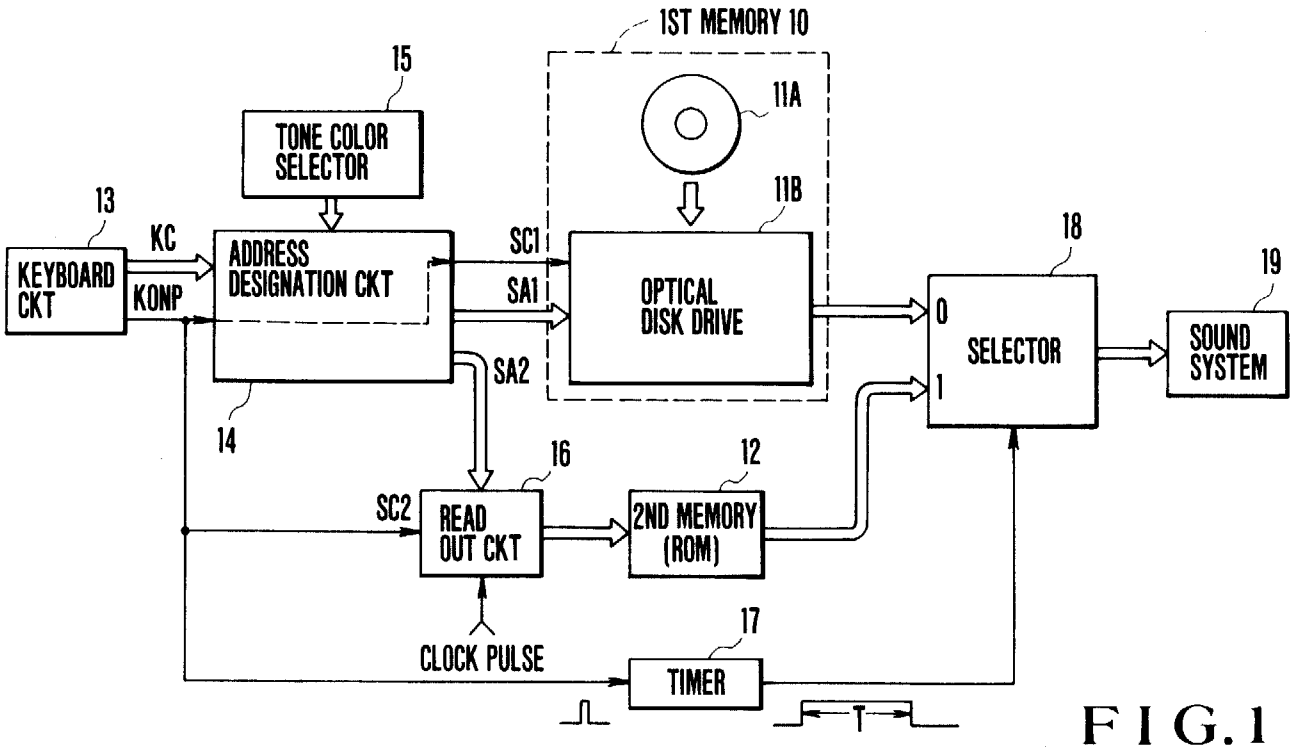
FIG. 1 is a block diagram of an electronic musical instrument according to an embodiment of the present invention.

Referring to FIG. 1, a first memory 10 comprises a large-capacity memory device such as an optical disk device, a magneto-optical disk device, or a floppy disk device. In the following description, the first memory 10 comprises an optical disk device. The optical disk device comprises an optical disk 11A and an optical disk drive 11B detachably receiving the optical disk 11A therein. The optical disk 11A mangeto-optically stores all waveform data of tone signals from the beginning to the end of a musical tone signal in units of keys and tone colors. A second memory 12 comprises a read-only memory (ROM) which has a smaller capacity but a higher speed than those of the optical disk 11A. The second memory 12 stores all waveform data from a tone start time to a predetermined time in units of keys and tone colors. A time interval between the start time and the predetermined time corresponds to a maximum access time (i.e., a time interval for reading out first one of waveform data to be read out from the optical disk 11A).

The relationship between the waveform data stored in the first memory 10, i.e., the optical disk 11A and the second memory 12 is illustrated in FIGS. 2A and 2B. FIG. 2A shows a waveform of a musical tone signal having a relatively long duration, and FIG. 2B shows a waveform of a musical tone signal having a relatively short duration. The waveform data for a predetermined time interval T from the beginning of the musical tone signal is stored in the second memory 12, and the waveform data after the predetermined time interval T to the end of the musical tone signal is stored in the optical disk 11A. The waveform data stored in the second memory 12 has a signal duration corresponding to the predetermined time interval T irrespective of the durations of the musical tone signals. It should be noted that the predetermined time interval T is exaggerated for illustrative convenience, but in practice, the interval T is so short that the second memory 12 can have a small capacity.

A keyboard circuit 13 detects a depressed key at a keyboard and generates a key code KC representing the depressed key and a one-shot key on pulse KONP generated at the very beginning of key depression. An address designation circuit 14 generates start address signals to the first and second memories 10 and 12 in accordance with the tone color selected by a tone color selector 15 and the key code KC. The start address signal accesses the start address at which waveform data corresponding to the selected tone color and the depressed key is stored. The address designation circuit 14 directly supplies read start address data SA1 to the first memory 10. The address designation circuit 14 supplies read start address data SA2 for the second memory 12 to a readout circuit 16. The key on pulse KONP is supplied as a read start command SC1 for the first memory 10 and as a read start command SC2 for the second memory 12 to the readout circuit 16. The key on pulse KONP is also supplied to a timer 17 which is then started.

In the optical disk drive 11B in the first memory 10, the data is read out from the recording medium (optical disk 11A) in response to the read start command SC1. This readout operation is started when the start address is accessed in response to the read start address data SA1. Thereafter, the read addresses are updated at a given rate. The data access at the desired address is performed such that a read head (not shown) is shifted to a position corresponding to a head address and reads out data from the recording medium (the optical disk 11A). Therefore, an access delay occurs at the initial period of access since head tracking requires a considerably long period of time. As a result, the waveform data cannot be readout at the timing of the key on pulse KONP.

The readout circuit 16 comprises a circuit for accessing the second memory 12 and includes an address counter for counting read clock pulses. When the read start command SC2 is supplied to the readout circuit 16 in response to the key on pulse KONP, the read start address data SA2 is supplied to the address counter therein. The clock pulses are then counted to sequentially update the read addresses. The waveform data is read out from the second memory 12 in accordance with the address access by the readout circuit 16. Since the second memory 12 is of a high-speed addressing type, the readout operation of the second memory 12 is spontaneously started in response to the key on pulse KONP. In other words, a musical tone can be produced with a negligible delay time which can be neglected by the player.

A selector 18 receives an output from the first memory 10 and an output from the second memory 12. One of the outputs from the first and second memories 10 and 12 is selected by the selector 18 in response to the output from the timer 17. The timer 17 counts a time corresponding to the tone generation time interval T of a tone corresponding to the waveform data. The timer 17 is kept high (logic "1") for the predetermined time interval T after the key on pulse KONP is received. During this interval, the selector 18 selects the output from the second memory 12. However, when the predetermined time interval T has elapsed, the output from the timer 17 goes low (logic "0"), and the selector 18 thus selects the output from the first memory 10. The output from the selector 18 is finally supplied to a sound system 19 which produces tones corresponding to the waveform data.

In this manner, during the predetermined time interval T since key depression, the waveform data read out from the second memory 12 is selected by the selector 18, and the musical tone signal is produced on the basis of this selected readout data. Thereafter, the waveform data read out from the first memory 10 is selected by the selector 18, and the musical tone signal is produced on the basis of this selected readout data. Since the first memory 10 is set in an accessible state after the predetermined time interval T, the necessary waveform data can then be immediately read out from the first memory 10. As shown in FIGS. 2A and 2B, the musical tone signals based on the waveform data read out from the first memory 10 follow the partial musical tone signals based on the waveform data read out from the second memory 12, respectively. Therefore, a good real-time musical performance can be obtained.

Figure 3:
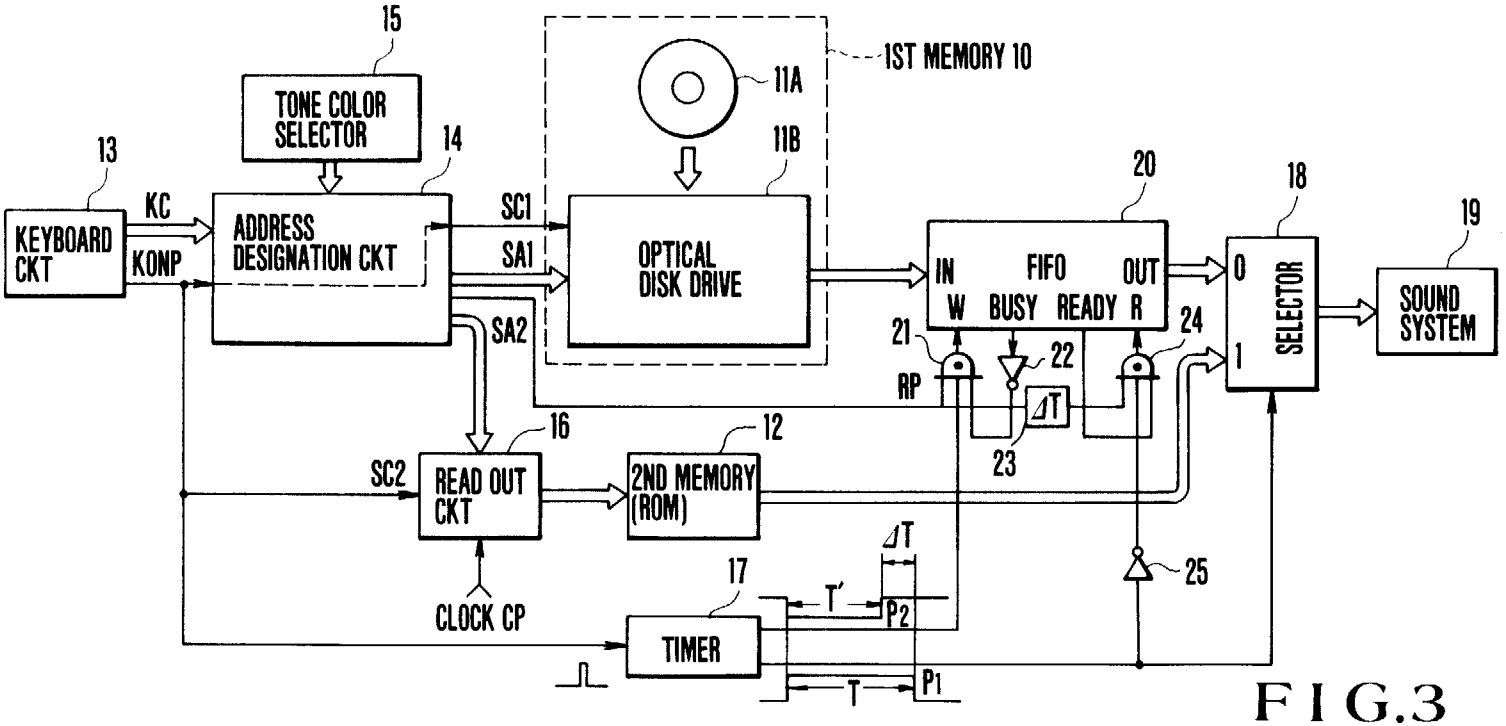
FIGS. 3 and 4 are respectively block diagrams for explaining storage distributions of the waveform data to be stored in the first and second memories of the electronic musical instrument shown in FIG. 1.

In order to smoothly read out the waveform data at the start address of the first memory 10 so as to smoothly follow the end of the waveform data read out from the second memory 12 when access operation is switched from the second memory 12 to the first memory 10 by means of the selector 18, a known FIFO (first-in first-out) buffer register is connected to the output terminal of the first memory 10. The waveform data read out from the optical disk 11A is temporarily stored in the FIFO buffer register. The contents of the FIFO buffer are sequentially read out, as shown in FIG. 3. The same reference numerals in FIG. 3 denote the same parts as in FIG. 1. Referring to FIG. 3, a FIFO buffer register 20 is arranged between an output of an optical disk drive 11B and a selector 18. A typical arrangement of the FIFO buffer register 20 is illustrated in FIG. 3. The FIFO buffer register 20 has an input terminal IN for receiving the waveform data signal from the optical disk drive 11B, an output terminal OUT for supplying the input waveform data to the selector 18, a write terminal W for receiving a write pulse instructing a write operation of the FIFO buffer register 20, a read terminal R for receiving a read pulse instructing a read operation of the FIFO buffer register 20, a busy terminal BUSY for generating a signal of logic "1" when data is written up to the maximum capacity of the FIFO buffer register 20 and a signal of logic "0" when data is not written up to the maximum capacity of the register 20, and a ready terminal READY for generating a signal of logic "1" when at least one data is written in the FIFO buffer register 20 (i.e., when read access can be performed) and a signal of logic "0" when no data is written in the FIFO buffer register 20. The write terminal W receives an output from an AND gate 21. The AND gate 21 receives a read pulse RP generated every time a read address supplied from an address designation circuit 14 to the optical disk drive 11B is updated, a control pulse P2 from a timer 17, and a pulse obtained by inverting the output from the terminal BUSY through an inverter 22.

The read rate of the read pulses RP corresponds to the pitch of a depressed key. When the player depresses a key, an address designation circuit 14 supplies the pulses SA1 and SA2 respectively representing the start addresses of the waveform data to the optical disk drive 11B of a first memory 10 and a readout circuit 16 so as to read out from the first and second memories 10 and 12 the waveform data corresponding to the key code KC identifying the depressed key from a keyboard circuit 13. In the optical disk drive 11B in the first memory 10, a read head (not shown) is shifted to a position represented by the pulse SA1. At the same time, the readout circuit 16 supplies to the second memory 12 address value sequentially updated from SA2 in response to the clock pulses CP, thereby sequentially reading out and supplying corresponding waveform data from the second memory 12 to the selector 18. Since the selector 18 selectively generates data to be supplied to an input terminal 1 in response to a pulse P1 from the timer 17 until the time interval T has elapsed after key depression, the waveform data read out from the second memory 12 is supplied to a sound system 19 during the time interval T after key depression. The musical tone is thus produced in accordance with the waveform data from the second memory 12. When the predetermined time interval T has elapsed after key depression, the read head is completely shifted to the position represented by the pulse SA1 and therefore accesses the corresponding data. In other words, unless the predetermined time interval T has elapsed after key depression, the data cannot be read out from the second memory 12. A longer time interval T' (T'>T) is actually set in the timer 17 to provide a margin. The pulse P2 is supplied to the terminal W through the AND gate 21 until the time interval T' has elapsed, thereby inhibiting writing of the waveform data read out from the first memory 10 in the FIFO buffer register 20. After the time interval T' has elapsed, the data corresponding to the pulse SA1 is read out from the first memory 10 and is fetched by the FIFO buffer register 20 in response to the read pulse RP supplied to the write terminal W through the AND gate 21. Thereafter, the read address of the first memory 10 is sequentially updated, and the address designation circuit 14 generates the read pulse RP every time the address is updated. As a result, the data stored in the first memory are sequentially supplied to the FIFO buffer register 20. When the FIFO buffer register 20 becomes full, the busy terminal BUSY generates the signal of logic "1" to disable the AND gate 21, thereby blocking further supply of the read pulse RP to the write terminal W. In this manner, waveform data from the first memory 10 is not received by the FIFO buffer register 20.

When a time interval between the write start time to time of memory full is given to be ΔT, and the read pulses RP are supplied to the read terminal R through a delay element 23 having a delay time corresponding to the time interval ΔT, the data in the FIFO buffer register 20 will not be read out until the memory becomes full. When the FIFO buffer register 20 becomes full, the waveform data transferred from the first memory 10 are sequentially read out from the FIFO buffer memory 20 in response to the read pulses RP in the order according to which they are read out from the first memory 10.

In the write disable state, one data is read out from the FIFO buffer register 20, and the busy terminal BUSY goes from logic "1" to logic "0", so that the FIFO buffer register 20 can then be set in the write enable state. Therefore, when the FIFO buffer register 20 receives a read pulse RP, it fetches data from the first memory 10. At the same time, the oldest data is read out from the FIFO buffer register 20, and sequential data readout can be performed. The data of the first memory 10 can be read out from the FIFO buffer register 20 when a time interval (T'+ΔT) has elapsed. The data are then supplied from the FIFO buffer register 20 to the sound system 19. However, before the time interval (T'+ΔT) has elapsed, the waveform data from the second memory 12 is supplied to the sound system 19. A pulse width (corresponding to the time interval T) of the pulse P1 is preset to be a sum of a pulse width (corresponding to the time interval T') of the pulse P2 and the time interval ΔT. The waveform data is read out from the second memory 12 during the time interval T after key depression, and the waveform data is read out from the first memory 10 (via the FIFO buffer register 20), thereby forming musical tones.

Figure 4:
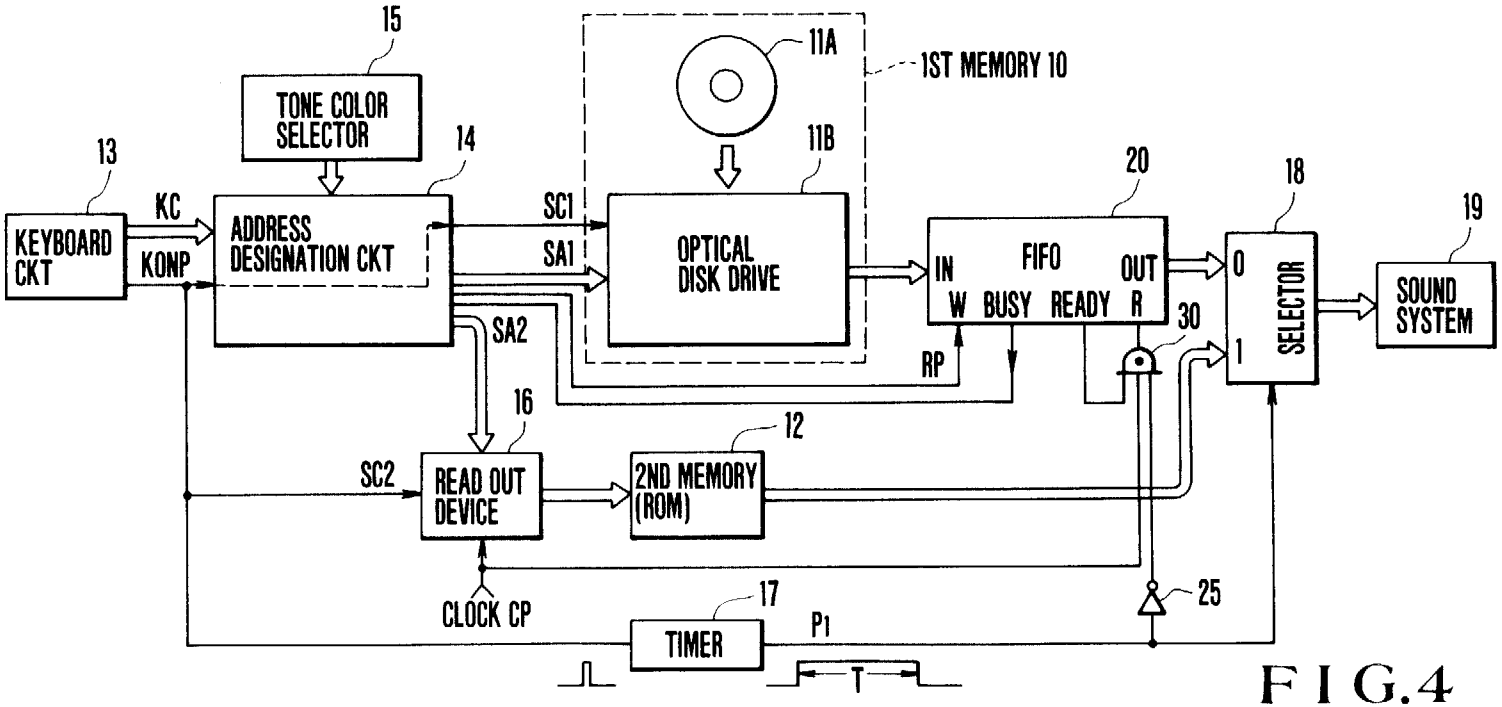

The FIFO buffer register 20 as shown in FIG. 4 may temporarily read out data from the optical disk 11A in the first memory 10 at a high read rate independently of the key depression pitch. In FIG. 4, the output from the FIFO buffer register 20 can be generated in synchronism with the readout operation of the second memory 12. The synchronized output from the FIFO buffer register is supplied to the selector 18. The same reference numerals in FIG. 4 denote the same parts as in FIG. 1.

An address designation circuit 14 supplies a read start address pulse SA1 to a first memory 10, and a read pulse RP is supplied to a write terminal W of a FIFO buffer register 20 in accordance with a signal (not shown) from an optical disk drive 11B every time a read operation is performed. The read pulses RP are successively supplied to the write terminal W until the FIFO buffer register 20 becomes full and a signal of logic "1" is generated from a busy terminal BUSY thereof. When the FIFO buffer register 20 becomes full, the address designation circuit 14 stops generating the read pulses RP. Thereafter, the FIFO buffer register 20 performs the read operation in response to the clock pulses CP. In other words, an output from an AND gate 30 is supplied to a read terminal R of the FIFO buffer register 20. The AND gate 30 receives the output from a ready terminal READY which indicates the read enable state since data is written in the FIFO buffer register 20, the clock pulse CP, and an inverted pulse $\overline{P1}$ obtained by inverting the output P1 from the timer 17 through an inverter 25. Therefore, the AND gate 30 supplies the clock pulses CP to the read terminal R while the AND gate 30 receives the pulses P1 from a timer 17 in response to the key on pulse KONP. The data stored in the FIFO buffer register 20 are sequentially supplied to the selector 18 in response to clock pulses CP supplied to the read terminal R.

When the contents stored in the FIFO buffer register 20 become zero, a signal of logic "0" is supplied from the busy terminal BUSY to the address designation circuit 14. Therefore, the read access of the first memory 10 is started, as previously described.

In the embodiment shown in FIG. 4, the start address data SA2 is supplied from the address designation circuit 14 to the readout circuit 16. The second memory 12 is accessed in response to the clock pulse CP, and the waveform data corresponding to the depressed key is read out from the second memory 12 and is supplied to the selector 18. The selector 18 supplies the data read out from the second memory 12 to the sound system 19 during the time interval T of the pulse P1 supplied from the timer 17. When the predetermined time interval has elapsed, the waveform data read out from the first memory 10 and supplied to the FIFO buffer register 20 is supplied to the sound system 19.

The second memory 12 comprises an ROM in the above embodiment. However, the second memory 12 may also comprise a random access memory (RAM) in place of the ROM. In this case, the peripheral circuitry of the second memory 12 is modified, as shown in FIG. 5. Referring to FIG. 5, a write device 40 is arranged in the circuit, and the output from the first memory 10 is supplied to the second memory 12. The write device 40 sets the second memory 12 in the write mode and supplies a read command to the first memory 10 when the circuit is powered or the tone color change mode is set in the tone color selector 15. A predetermined waveform data set is stored in a predetermined memory area of the first memory 10 and is stored in the second memory 12 in response to the read command from the write device 40. When data is written in the second memory 12 in the tone color change mode, the waveform data set corresponding to the updated tone color is read out from the first memory 10 and stored in the second memory 12.

The first memory 10 comprises a large-capacity memory device such as an optical disk device or a floppy disk device. However, a large-capacity low-speed semiconductor memory may also be used as the first memory 10. The principal object of the present invention lies in the fact that the waveform data is read out from the high-speed second memory for a time interval until the first memory, as a recording medium having a long access time, becomes accessible, and the first memory is used when it is ready, thereby substantially decreasing the access time.

Every time an access delay occurs (this is not limited to the beginning of production of the musical tone signal but can also occur when the read track changes in the optical disk 11A), the waveform data subjected to such access delay can be stored in the second memory, and the switching operation as described above is performed to obtain a smooth musical performance. The recording tracks of the optical disk can be changed from concentric tracks to helical tracks, thereby eliminating the access delay during the read track changes.

According to the present invention, even if a large-capacity memory subjected to access delay is used, it can be built into an electronic musical instrument so as to achieve real-time musical performance.

What is claimed is:

1. An electronic musical instrument comprising:

first memory means having a large capacity and of a low-speed access type for storing first waveform data corresponding to a first portion from a first point to a second point of a tone waveshape of a tone to be produced;

second memory means, which is smaller in capacity and faster in access than those of said first memory, for storing second waveform data corresponding to a second portion form a third point to a fourth point of said tone waveshape, said third point, said fourth point, said first point and said second point being in this order on time series and time length corresponding to said second portion being equal to or longer than an access time required to independently read out data corresponding to said first point from said first memory;

read out means for reading out said second waveform data and said first waveform data from said second memory means and said first memory means respectively;

control means for generating a control signal relating to said time length corresponding to said second portion;

delivering means connected to said second memory means, said first memory means and said control means, for delivering said second waveform data firstly and then for delivering said first waveform data in accordance with said control signal; and tone production means for producing a tone in accordance with said selected second waveform data and said delivered first waveform data.

2. An electronic musical instrument according to claim 1, wherein said first memory is a memory device of a type with a read head, said access time is defined by a time for moving said read head toward a memory location corresponding to said first point after receiving a readout instruction from said read out means and then accomplishing the readout of the data corresponding to said first point.

3. An electronic musical instrument according to claim 1, wherein said first memory is a memory medium selected from the group consisting of a floppy memory medium, an optical memory medium, a magnet-optical medium, and an semiconductor memory medium.

4. An electronic musical instrument according to claim 1, wherein said second memory is constituted by a semiconductor memory device.

5. An electronic musical instrument according to claim 1, wherein said fourth point of said tone waveshape is adjacent to said first point thereof.

6. An electronic musical instrument according to claim 1, which said first memory further stores said second portion.

7. An electronic musical instrument according to claim 6, wherein said second memory comprises an RAM, said second waveform data being in advance stored in said RAM in response to power on of said electronic musical instrument.

8. An electronic musical instrument according to claim 1, wherein said third point and said second point correspond to a start and a termination of the tone production of said tone respectively.

9. An electronic musical instrument according to claim 1, which further comprises a keyboard having a plurality of keys, each of which designates a pitch of said tone and wherein said read out means reads out said second waveform data and said first waveform data in accordance with the designated pitch.

10. An electronic musical instrument according to claim 1, which further comprises tone color selecting means for selecting a tone color to be imparted to said tone.

11. An electronic musical instrument according to claim 10, wherein said second memory comprises an RAM and said first memory further stores said second portion, said second waveform data being in advance stored in said RAM in response to the tone color selection by said tone color selecting means.

12. An electronic musical instrument according to claim 1, which further comprises buffer means provided between said first memory means and said delivering means and wherein said read out means further transmits said read out first waveform data to said buffer means and then reads out said transferred first waveform data stored temporarily in said buffer means, said control signal being further relating to time length required to be from an empty state to a full state in said buffer means.

13. An electronic musical instrument according to claim 12, which further comprises a keyboard having a plurality of keys, each of which designates a pitch of said tone and wherein said read out means starts to read out said second waveform data and said first waveform data in response to a key depression.

14. An electronic musical instrument according to claim 13, wherein said read out means transmits said read out first waveform data at a rate corresponding to the pitch designated by said key depression.

15. An electronic musical instrument according to claim 13, wherein said read out means transmits said read out first waveform data at a rate independent of the pitch designated by said key depression.

16. An electronic musical instrument according to claim 12, wherein said buffer means comprises an FIFO register.

* * * * *